US007232381B2

(12) United States Patent
Imamoto et al.

(10) Patent No.: US 7,232,381 B2
(45) Date of Patent: Jun. 19, 2007

(54) IRON GOLF CLUB HEAD

(75) Inventors: Yasunori Imamoto, Tokyo (JP); Hisashi Yamagishi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/849,547

(22) Filed: May 20, 2004

(65) Prior Publication Data

US 2005/0009626 A1 Jan. 13, 2005

(30) Foreign Application Priority Data

Jul. 3, 2003 (TW) ..... D92304100
Sep. 1, 2003 (JP) ..... P2003-308932

(51) Int. Cl.
*A63B 53/04* (2006.01)
*A63B 53/06* (2006.01)

(52) U.S. Cl. ..... 473/345; 473/347; 473/350

(58) Field of Classification Search ..... 473/324–350
See application file for complete search history.

(56) References Cited

U.S. PATENT DOCUMENTS

| | | | | |
|---|---|---|---|---|
| 3,845,960 | A * | 11/1974 | Thompson | 473/336 |
| 4,792,139 | A | 12/1988 | Nagasaki et al. | |
| 4,798,383 | A | 1/1989 | Nagasaki et al. | |
| 4,874,171 | A | 10/1989 | Ezaki et al. | |
| 4,884,812 | A | 12/1989 | Nagasaki et al. | |
| 4,928,972 | A | 5/1990 | Nakanishi et al. | |
| 4,964,640 | A | 10/1990 | Nakanishi et al. | |
| 5,228,694 | A | 7/1993 | Okumoto et al. | |
| 5,350,556 | A | 9/1994 | Abe et al. | |
| 5,643,103 | A * | 7/1997 | Aizawa | 473/290 |
| 5,674,133 | A | 10/1997 | Chang et al. | |
| 5,722,900 | A * | 3/1998 | Sung | 473/291 |
| 6,010,411 | A | 1/2000 | Reyes | |
| 6,875,124 | B2 * | 4/2005 | Gilbert et al. | 473/290 |
| 2004/0266550 | A1 * | 12/2004 | Gilbert et al. | 473/345 |

FOREIGN PATENT DOCUMENTS

| | | |
|---|---|---|
| JP | 62-97570 A | 5/1987 |
| JP | 63-5768 A | 1/1988 |
| JP | 63-19169 A | 1/1988 |
| JP | 6-39941 A | 2/1994 |
| JP | 8-24377 A | 1/1996 |
| JP | 9-38250 A | 2/1997 |
| JP | 10-15119 A | 1/1998 |

* cited by examiner

*Primary Examiner*—Stephen Blau
*Assistant Examiner*—Alvin A. Hunter, Jr.
(74) *Attorney, Agent, or Firm*—Sughrue Mion, PLLC

(57) ABSTRACT

An iron golf club head includes a head main body and an FRP body. The head main body includes a face portion, a first face along the face portion, second faces, and a recess behind the head portion. The second faces continue from a rear face of the face portion to the first face. The recess is defined by the first face and the second faces. The hollow FRP body is disposed in the recess, overlaps the first face and the second faces, and closes an opening portion of the recess. At least a part of crossing corner portions between the first face and the second faces has a curved face.

9 Claims, 6 Drawing Sheets

IRON GOLF CLUB HEAD

BACKGROUND OF THE INVENTION

1. Field of the Invention

The present invention relates to a golf club head for batting the golf ball, and particularly to an iron golf club head. More particularly, the invention relates to an iron golf club head including a head main body having a recess (cavity) opening at the rear face, and an FRP body provided in the recess.

2. Description of the Related Art

Conventionally, the iron golf club heads were made of metal material alone such as stainless steel or cast iron. Recently, the iron golf club heads with an FRP (fiber reinforced plastic) material disposed behind the head main body have been available on the market.

For example, JP-A-Sho.62-97570 discloses an iron club in which a CFRP (carbon fiber reinforced plastic) layer is attached on the back face of a hitting face to enhance the feeling of batting.

Also, JP-A-Sho.63-19169 discloses that the CFRP layer is attached on the back face of the hitting face and covered with a plastic backup member. FIG. 5 of JP-A-Sho.63-19169 shows an iron golf club head in which the entrance portion of cavity is closed with the backup member to make the FRP member a hollow structure.

FIG. 4 corresponds to FIG. 5 of the JP-A-Sho.63-19169. A head main body 1 of this iron club head includes a recess 4 behind a hitting face portion 2, and a rising portion 8 standing from the rear edge of a sole face portion 3.

A fiber reinforced member 5 is intimately affixed on the inner face of the recess 4. The fiber reinforced member 5 has a hollow shell structure. JP-A-Sho.63-19169 is silence on how the fiber reinforced member 5 with the hollow shell structure is disposed or formed within the recess 4. A backup member 6 is formed by filling a constituent resin material into the recess 4 to cover the fiber reinforced member 5 and conducting a curing process (left upper column and left lower column in page 5 of JP-A-Sho.63-19169).

SUMMARY OF THE INVENTION

In the head main body of JP-A-Sho.63-19169 shown in FIG. 4, the corner portion of the recess 4 has an acute angle. At such corner portion, a void is likely to occur between the head main body 1 and the fiber reinforced member 5. If there is such void, the irregular vibration occurs at the time of hitting the golf ball, aggravating the feeling of hitting.

The invention provides an iron golf club head including a head main body and an FRP body intimately disposed in a recess without a void.

According to an embodiment of the invention, an iron golf club head includes a head main body and a FRP body. The head main body includes a face portion, a first face along the face portion, second faces, and a recess. The second faces continue from a rear face of the face portion to the first face. The recess is behind the head portion and is defined by the first face and the second faces. The hollow FRP body is disposed in the recess, overlaps the first face and the second faces, and closes an opening portion of the recess. At least a part of crossing corner portions between the first face and the second faces has a curved face.

80% or more of the crossing corner portions in total length in a circumferential direction may have the curved faces.

In such iron golf club head, since at least the part of the crossing corner portion between the first face and the second faces has the curved face, a void is prevented from occurring between the FRP body and the head main body in the crossing corner portion.

It is preferred that the FRP body is a lamination of plural sheets of UD prepreg containing long fiber such as carbon fiber or glass fiber, or the prepreg of cross of such fiber, and closely contacted with the head main body.

Particularly, it is preferred that two to four layers of UD prepregs are overlapped so that fibrous directions of the UD prepregs are different from each other and that a cross fiber, which is beautiful to the eye, is disposed on an outermost layer so that the cross fiber can be viewed.

Particularly, if the FRP body is blow molded within the recess, the void between the recess and the circumferential wall face is suppressed almost completely. In this case, if the opening portion of the recess decreases in area as approaching the rear face of the head main body, the void between the entrance edge part of the recess and the FRP body is eliminated.

A high specific gravity resin layer may be provided on the first face, or in a lower and rear portion of the recess. By providing this high specific gravity resin layer, the vibration absorption characteristic at the time of shot is improved. Also, the center of gravity is deepened to stabilize the shot. Moreover, the iron golf club head is adjusted in weight in terms of the high specific gravity resin layer.

BRIEF DESCRIPTION OF THE DRAWINGS

FIG. 5 is a schematic view showing another embodiment.

DETAILED DESCRIPTION OF THE PREFERRED EMBODIMENTS

Figure 1:
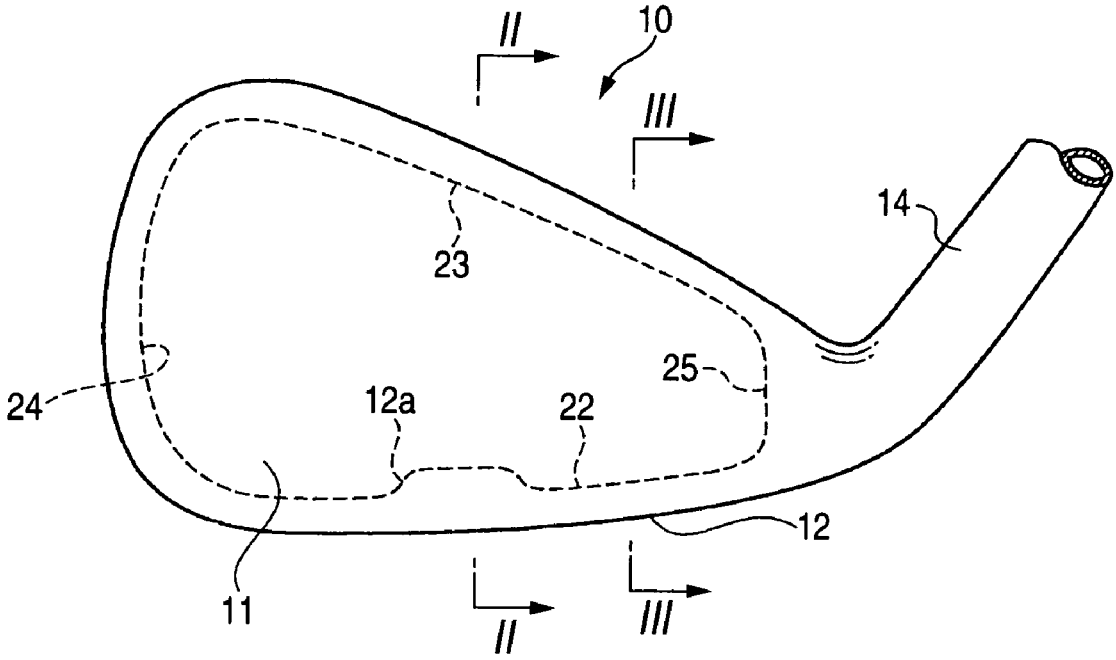
FIG. 1 is a front view of an iron golf club head according to an embodiment of the present invention.
Figure 2:
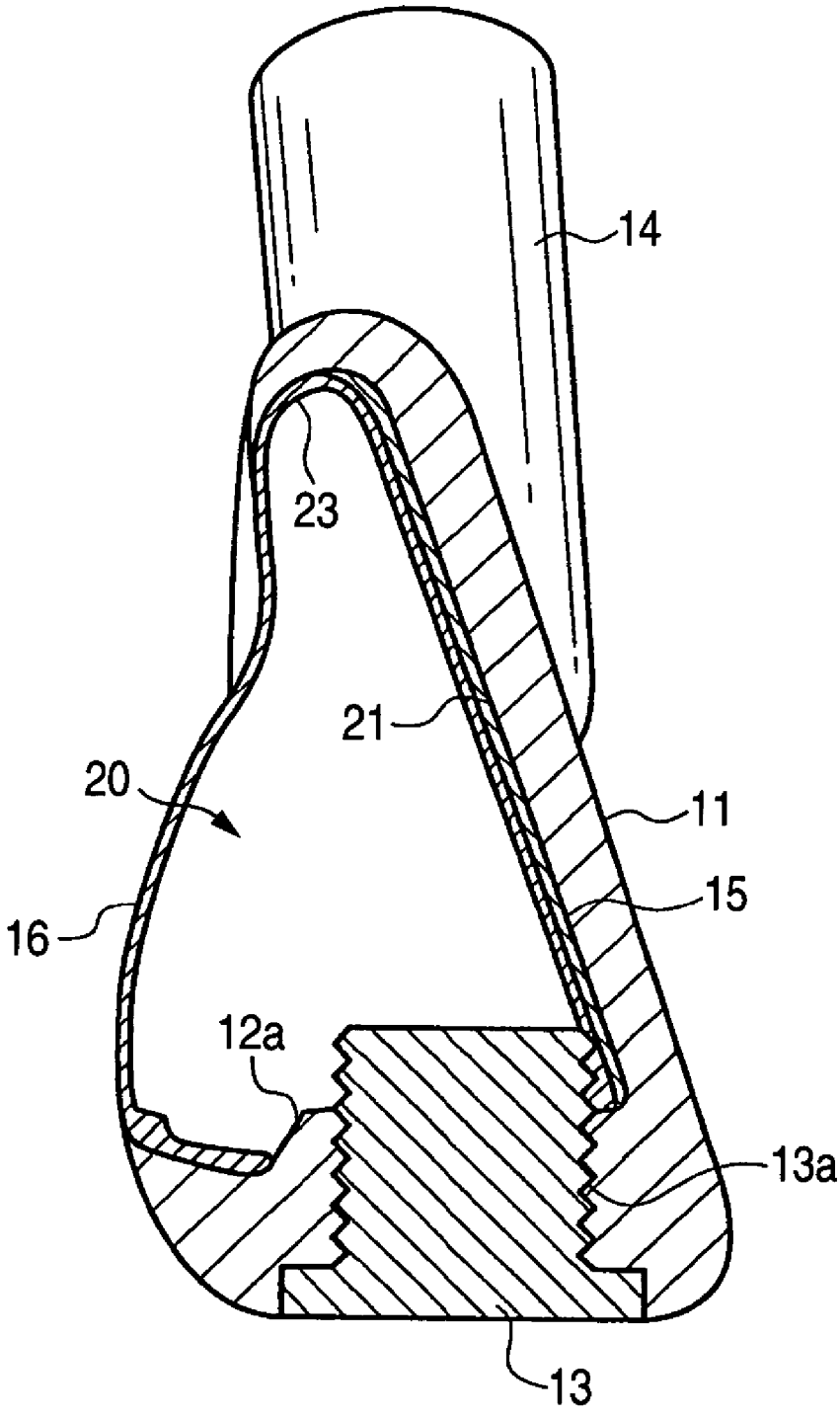
FIG. 2 is a section view taken along the line II—II in FIG. 1.
Figure 3:
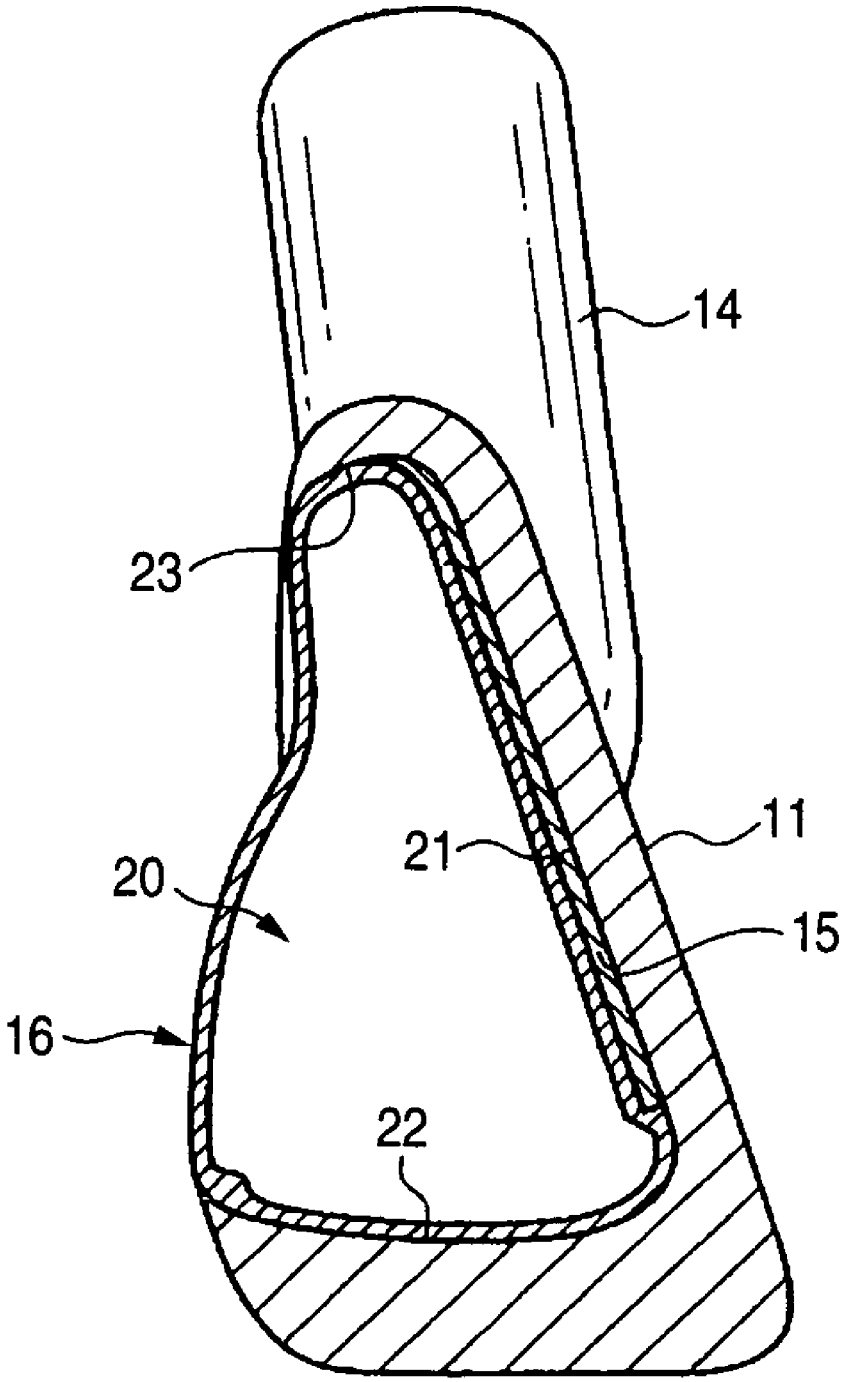
FIG. 3 is a section view taken along the line III—III in FIG. 1.
Figure 4:
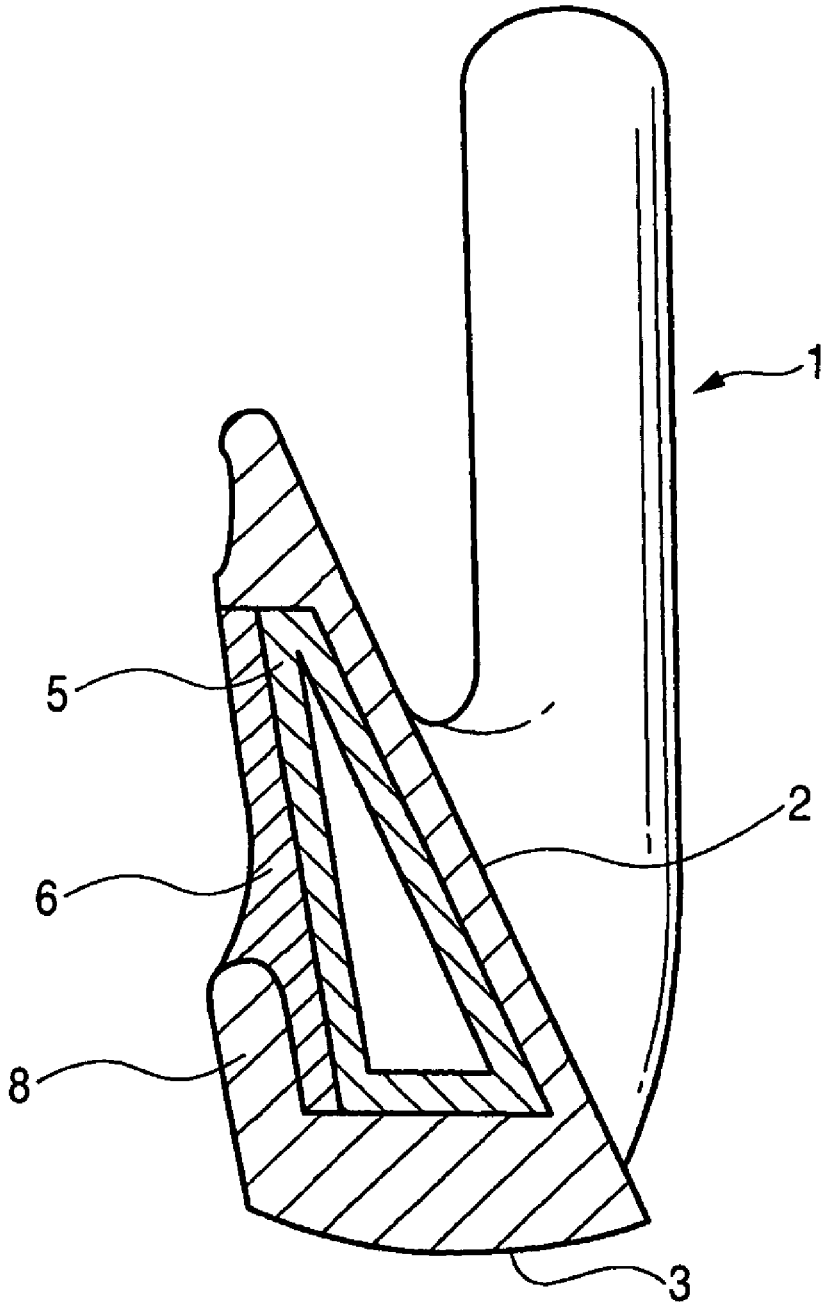
FIG. 4 PRIOR ART
FIG. 4 is a section view of the conventional iron golf club head.

The preferred embodiments of the invention will be described below with reference to the accompanying drawings. FIG. 1 is a front view of an iron golf club head according to an embodiment of the invention. FIG. 2 is a section view taken along a line II—II. FIG. 3 is a section view taken along a line III—III.

A head main body 10 of this iron golf club head includes a face portion 11 for batting the ball and a sole portion 12 continuously connected to the lower edge of the face portion 11. A weight material 13 is fixed to the sole portion 12. A shaft (not shown) is fitted into a hosel portion 14 of the head main body 10.

The head main body 10 is made of metal such as stainless. The face portion 11 may be made of titanium or titanium alloy, and the other portions may be made of stainless.

The head main body 10 includes a recess 20 opening at the rear face. An inner most face 21 of this recess 20 is parallel to a front face of the face portion 11. The face portion 11 has a plate shape having almost uniform thickness. The circumferential wall faces of the recess 20 continue from the rear face of the head main body 10 to the innermost face 21. The circumferential wall faces include a circumferential wall face 22 on the sole side, a circumferential wall face 23 on the upper edge side, a circumferential wall face 24 on the toe side and a circumferential wall face 25 on the heel side.

Each of the crossing corner portions between the circumferential wall faces 22 to 25 and the innermost face 21 is a curved face, which is curved smoothly and concavely, except for the neighborhood of a base portion 12*a* of the sole portion 12. The radius of curvature of each curved face is in a range of from 1.5 mm to 80 mm, preferably in a range of from 2 mm to 60 mm, in order to produce no gap between the head main portion 10 and the FRP body 16 at this crossing corner portion.

The entrance side (rear face side of the head main body 10) of the recess 20 has a narrow shape in which the opening area is gradually smaller as approaching the rear face of the head main body 10. As shown in FIG. 2, the thickness of an edge portion on the entrance side of the recess 20 gradually decreases as approaching the center of the entrance. The longitudinal section of the edge portion has an acute angle shape.

A high specific gravity resin layer 15 is bonded onto the innermost face 21. Preferably, the high specific gravity resin layer 15 includes a resin material, such as epoxy, nylon, polyester, urethane, ABS, or thermoplastic elastomer, to which a high specific gravity metal powder having a specific gravity of 10 or more such as tungsten or tungsten alloy is blended. The specific gravity of the high specific gravity resin layer 15 is in a range of from 10 to 17, preferably in a range of from 10 to 14. The thickness of the high specific gravity resin layer 15 is preferably in a range of from 0.4 mm to 1.2 mm. It is preferable that the high specific gravity resin layer 15 is provided almost all over the innermost face 21. However, the high specific gravity resin layer 15 may be provided to cover 50% or more, especially 60% or more of the innermost face 21 to contain the neighborhood of the center of the innermost face 21. In this embodiment, the high specific gravity resin layer 15 is provided to have its peripheral edge slightly extending over the circumferential wall faces 22 to 25.

This high specific gravity resin layer 15 is provided to absorb the vibration at the time of shot, and facilitate the adjustment of the weight of the iron golf club head.

In order to form a screw hole 13*a* for attaching the weight material 13 in the sole portion 12, the head main body 10 is thickened in the neighborhood of the center in the toe-heel direction so that the base portion 12*a* is formed. The screw hole 13*a* penetrates the base portion 12*a* vertically. The weight portion 13 may not be screwed, but may be fixed to the head main body 10 by welding.

The FRP body 16 is provided along an inner face of the recess 20. The FRP body 16 has a hollow shell shape to cover the high specific gravity resin layer 15, as well as the circumferential wall faces 22 to 25, and to close an entrance portion of the recess. On the rear face of the head main body 10, the FRP body 16 is flush with the rear face of the head main body.

The FRP body 16 is blow molded within the recess 20. To conduct the blow molding, first of all, a sheet-like element of the high specific gravity resin layer 15 is inserted into the recess 20 of the head main body 10 before the weight material 13 is attached, and superposed on the innermost face 21. The sheet-like element may be one sheet, but is preferably a lamination of plural thin films. The lamination of plural thin films easily deforms flexibly and lies along the inner face of the recess 20.

Then, the element of the FRP body 16 is inserted into the recess 20. The element of the FRP body 16 has a hollow shell shape slightly smaller than the recess 20. The element of the FRP body 16 is disposed to overlap the element assembly of the high specific gravity resin layer 15 and the circumferential wall face 22. A nylon bag is disposed within the FRP element.

The element of the FRP body 16 includes uncured fiber reinforced synthetic resin. Carbon fiber is suitable to this fiber. However, the fiber is not limited thereto. For a portion making up the rear face of the FRP body 16, it is preferred that a woven cloth such as carbon fiber cloth is disposed on the outermost layer, and that a net pattern appears on the rear face of the FRP body 16.

The nylon bag is disposed inside the element of this FRP body 16, as described above. This nylon bag and the element of the FRP body 16 are provided with transparent openings at a position over the screw hole 13*a*.

After the element of the FRP body 16 is inserted into the recess 20, the iron golf club head 10 is fitted into a mold for blow molding. A gas such as the air is supplied through the screw hole 13*a* into the element of the FRP body to inflate the bag. Thereby, the element of the high specific gravity resin layer 15 is pushed against the innermost face 21, and the element of the FRP body 16 is closely contacted with the element of the high specific gravity resin layer 15, the circumferential wall faces 22 to 25 and the inner face of the mold. Then, the mold is heated to cure each element. Thereafter, the mold is released. After releasing the mold, the bag body is pulled through the screw hole 13*a*, and the weight material 13 is screwed into the screw hole 13*a*.

With this blow molding, the iron golf club head in which the high specific gravity resin layer 15 and the FRP body 16 are closely contacted with the cross corner portions between the innermost face 21 and the circumferential wall faces 22 to 25. In this embodiment, since the entrance side of the recess 20 is narrower, the FRP body 16 is also closely contacted with the inner face of the recess at the peripheral edge of the entrance. A portion of the FRP body 16 exposed to the rear face of the head main body 10 and the rear face of the head main body 10 are smoothly continuous as one plane.

Figure 5A:
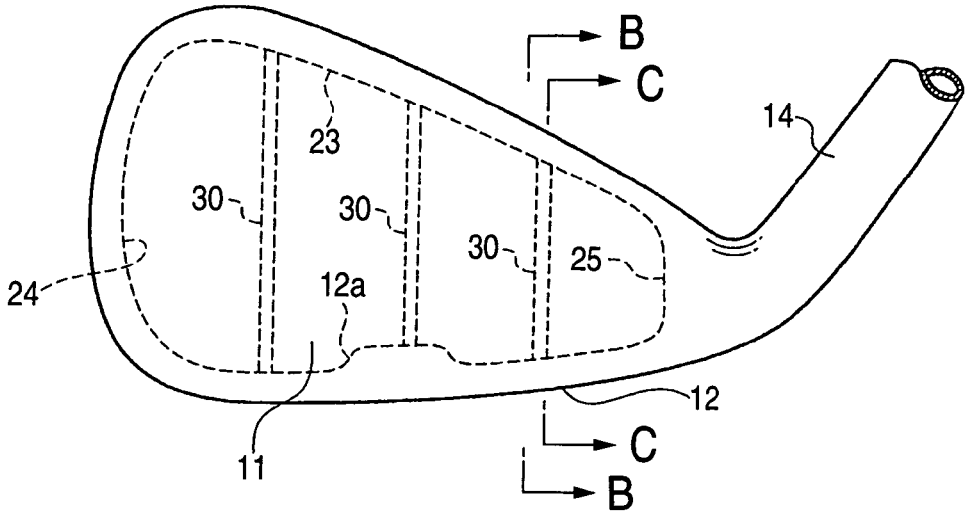
FIGS. 5A, 5B and 5C are schematic views showing another embodiment.
Figure 5B:
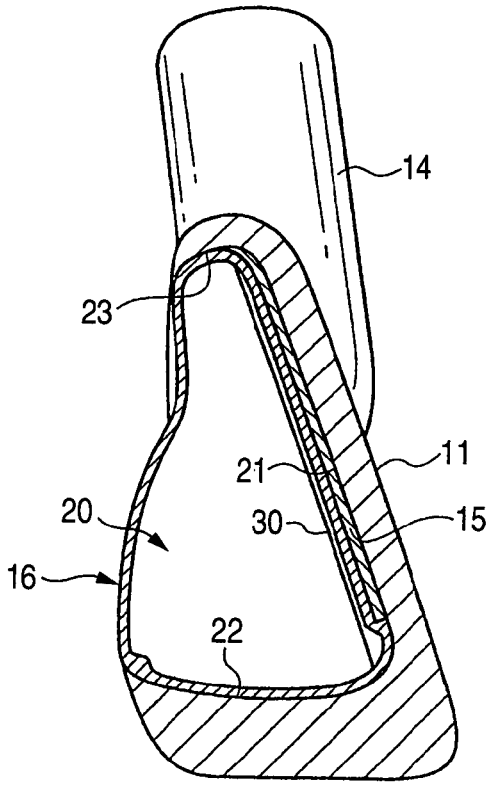
Figure 5C:
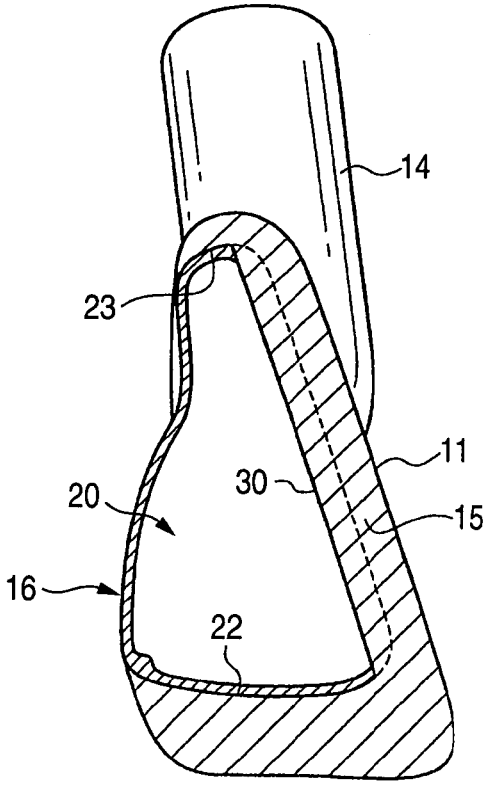

FIG. 5 is a schematic view of a golf club head with ribs 30 provided on the innermost face 21, according to another embodiment of the invention. FIG. 5A is a front view, FIGS. 5B and 5C are the section views taken along line B—B and line C—C.

In this embodiment, three ribs 30 extending vertically are provided. Each rib 30 extends from the circumferential wall face 23 on the upper edge side to the circumferential wall face 22 on the sole side. The ribs 30 can improve feeling when the gold club head hits the ball.

On the innermost face 21, the high specific gravity resin layer 15 and the FRP body 16 are disposed between the ribs 30, 30. The ribs 30 are not covered with the high specific gravity resin layer 15 or the FRP body 16. The other configuration of the iron golf club head of FIG. 5 is the same as that of the previous embodiment. The same numerals are used to designate the same or like parts.

Figure 6:
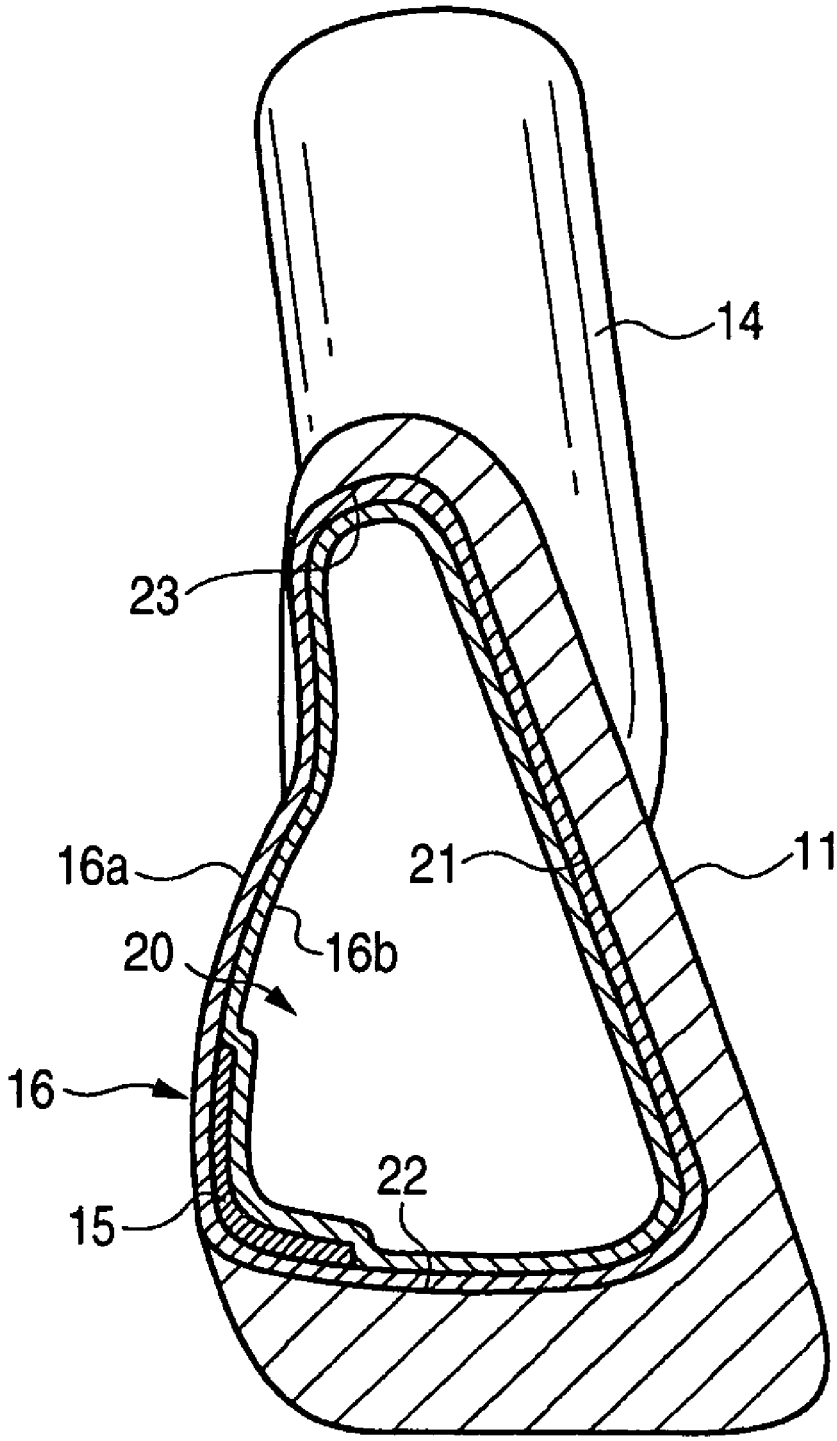
FIG. 6 is a section view showing still another embodiment.

FIG. 6 is a section view of the iron golf club head in which the high specific gravity resin layer 15 is provided in the lower and back part of the recess 20, according to still another embodiment of the invention.

This high specific gravity resin layer 15 is disposed from the back part of the circumferential wall face 23 on the sole side to the lower part of the rear face of the FRP body 16. The high specific gravity resin layer is not provided on the innermost face 21.

The FRP body 16 includes two layers, that is, an outer layer 16*a* and an inner layer 16*b*. The high specific gravity resin layer 15 is disposed between the outer layer 16*a* and the inner layer 16*b* and embedded in the FRP body 16.

The other configuration of the iron golf club head is the same as that of the embodiment of FIGS. 1 to 4. The same numerals are used to designate the same or like parts.

Since this iron golf club head has a deep and low center of gravity, the trajectory of the hit ball is stable and a golfer can make high shot easily.

The invention has been described in the illustrative embodiments, but may take other embodiments than those illustrated. For example, the weight material 13 may be omitted in the invention. Also, an elastic body or a shock absorber, such as rubber, resin or elastomer, for absorbing the vibration may be bonded on the inner face of the FRP body 16.

In the embodiment in which the ribs are provided as shown in FIG. 5, the high specific gravity resin layer 15 may be provided in the lower and back part of the recess 20.

EXAMPLES 1 AND 2

In the golf club head as shown in FIGS. 1 to 4, the radius of curvature of the crossing corner portion between the upper circumferential wall face 23 and the innermost face 21 was made to be 2 mm, and the radius of curvature of the crossing corner portion between the circumferential wall face 22 on the sole side and the innermost face 21 was made to be 50 mm or 70 mm. The FRP body 16 was a lamination of three layers, that is, two layers of UD prepreg using carbon fiber having an elastic modulus of 24 t/mm$^2$ and one layer of cross prepreg using the came carbon fiber.

As a result, each golf club head had an excellent feeling of batting.

EXAMPLES 3 AND 4

The golf club head was fabricated with the same configuration as the examples 1 and 2, except that the high specific gravity resin layer 15 was omitted. These golf clubs provided a better feeling when hitting the ball.

EXAMPLE 5

The golf club head was fabricated with the same configuration as example 1, except that the ribs 30 were provided as shown in FIG. 5. The width of rib in the toe-heel direction was 2 mm, and the height from the innermost face 21 was 2 mm.

This golf club head had a quite excellent feeling of batting.

EXAMPLE 6

The golf club head was fabricated with the same configuration as example 1, except that the high specific gravity resin layer 15 was disposed on the sole side as shown in FIG. 6. The high specific gravity resin layer 15 along the innermost face 21 is omitted. This golf club head had an excellent feeling of batting, and a stable flying distance.

What is claimed is:

1. An iron golf club head comprising:

a head main body including:

a hitting face;

a first face along the hitting face;

second faces, which continue from a rear of the head main body to the first face, the first face and the second faces defining a recess behind the hitting face;

a corner portion between the first face and the second faces, at least a part of the corner portion having a curved surface; and a resin layer, which has higher specific gravity than the head main body and is disposed on the first face; wherein a hollow FRP body, which is disposed in the recess, overlaps the first face and the faces, and closes an opening portion of the recess.

2. The iron golf club head according to claim 1, wherein the resin layer is disposed between the head main body and the FRP body.

3. The iron golf club head according to claim 1, wherein the resin layer is embedded in the FRP body.

4. The iron golf club head according to claim 1, wherein the resin layer includes a resin containing metal power having 10 or more in specific gravity.

5. An iron golf club head comprising:

a head main body including:

a hitting face;

a first face along the hitting face;

second faces, which continue from a rear of the head main body to the first face, the first face and the second faces defining a recess behind the hitting face; and a corner portion between the first face and the second faces, at least a part of the corner portion having a curved face; wherein a hollow FRP body, which is disposed in the recess, overlaps the first face and the second faces, and closes an opening portion of the recess; and wherein a curvature radius of the curved face is in a range of from 1.5 mm to 80 mm; and further comprising:

a resin layer, which has higher specific gravity than the head main body and is disposed in lower and rear portion of the recess.

6. The iron golf club head according to claim 5, wherein the resin layer is disposed between the head main body and the FRP body.

7. The iron golf club head according to claim 5, wherein the resin layer is embedded in the FRY body.

8. The iron golf club head according to claim 5, wherein the resin layer includes a resin containing metal power having 10 or more in specific gravity.

9. An iron golf club head comprising:

a head main body including:

a hitting face;

a first face along the hitting face;

second faces, which continue from a rear of the head main body to the first face, the first face and the second faces defining a recess behind the hitting face; and a corner portion between the first face and the second faces, at least a part of the corner portion having a curved face; wherein a hollow FRP body, which is disposed in the recess, overlaps the first face and the second faces, and closes an opening portion of the recess; and wherein a curvature radius of the curved face is in a range of from 1.5 mm to 80 mm; and further comprising:

a third face along a sole portion of the golf club head, the third face continuing to the first face; and another corner portion between the first face and the third face, at least part of the other corner portion having another curved face, wherein:

a curvature radius of the corner portion between the first face and the second faces is smaller than that of the corner portion between the first face and the third face.

* * * * *

UNITED STATES PATENT AND TRADEMARK OFFICE

CERTIFICATE OF CORRECTION

PATENT NO. : 7,232,381 B2
APPLICATION NO. : 10/849547
DATED : June 19, 2007
INVENTOR(S) : Yasunori Imamoto and Hisashi Yamagishi It is certified that error appears in the above-identified patent and that said Letters Patent is hereby corrected as shown below:

In claim 7 at column 6, line 48 please change "the resin layer is embedded in the FRY body." to --the resin layer is embedded in the FRP body--

Signed and Sealed this

Twenty-third Day of October, 2007

JON W. DUDAS
*Director of the United States Patent and Trademark Office*